US005626548A

United States Patent [19]

Coyle

[11] Patent Number: 5,626,548

[45] Date of Patent: May 6, 1997

[54] LOWER-BODY EXERCISE MACHINE

[76] Inventor: Randy Coyle, 5-A Great Meadow La., East Hanover, N.J. 07936

[21] Appl. No.: 398,373

[22] Filed: Mar. 3, 1995

[51] Int. Cl.[6] ..... A63B 21/08; A63B 23/04

[52] U.S. Cl. ..... 482/137; 482/95; 482/97; 482/98; 482/134; 482/139; 482/142

[58] Field of Search ..... 482/72, 92–98, 482/104, 106, 123, 130, 133–137, 139, 142, 148, 908; 601/35

[56] References Cited

U.S. PATENT DOCUMENTS

| | | | |
|---|---|---|---|
| 3,010,720 | 11/1961 | Allard | 482/97 |
| 4,176,836 | 12/1979 | Coyle . | |
| 4,377,281 | 3/1983 | Jesernig et al. | 482/96 |
| 4,407,495 | 10/1983 | Wilson | 482/97 |
| 4,509,746 | 4/1985 | Mask | 482/137 |
| 4,535,985 | 8/1985 | Mask . | |
| 4,564,194 | 1/1986 | Dawson | 482/98 |
| 4,575,077 | 3/1986 | Osbourne et al. | 482/137 |
| 4,618,144 | 10/1986 | Gibson | 482/138 |
| 4,872,670 | 10/1989 | Nichols . | |
| 5,106,079 | 4/1992 | Escobedo et al. | 482/137 |
| 5,108,095 | 4/1992 | Nichols . | |
| 5,116,297 | 5/1992 | Stonecipher | 482/137 |
| 5,184,992 | 2/1993 | Banks | 482/98 |
| 5,201,694 | 4/1993 | Zappel . | |
| 5,263,913 | 11/1993 | Boren . | |

FOREIGN PATENT DOCUMENTS

| | | |
|---|---|---|
| 1381177 | 2/1985 | U.S.S.R. . |
| 1326292 | 7/1987 | U.S.S.R. . |
| 1657209 | 6/1991 | U.S.S.R. . |

OTHER PUBLICATIONS

Parabody 1995 Product Catalog, Rotary Smith Machine 864.

*Primary Examiner*—Richard J. Apley
*Assistant Examiner*—Victor K. Hwang
*Attorney, Agent, or Firm*—Lee R. Osman

[57] ABSTRACT

A lower-body exercise machine is provided having a frame, a carriage assembly pivotally attached to the frame and moveable in an upwardly and downwardly arcuate path about the frame, a support beam attached to and extending upwardly from the frame, and a platform pivotally attached to the frame and angling downwardly. A hookbar assembly is pivotally attached to the carriage assembly for releasably engaging the support beam to arrest the downward motion of the carriage assembly. The hookbar assembly comprises a hook bar rotatably attached to the carriage assembly, an elongated hook attached to and extending upwardly from the hook bar, and an elongated engagement handle attached to the hook bar. A rung is attached to the support beam. By moving the engagement handle upwardly, the hook bar rotates and pivots the hook towards the support beam to engage the rung and arrest the downward movement of the carriage assembly. To release the hook from the rung, the upward movement of the carriage assembly disengages the hook from the rung, and the weight of the engagement levers automatically cause the hook to pivot towards the carriage assembly. The carriage assembly includes a plurality of elongated roller pads, each roller pad being rotatably attached to the carriage assembly and able to freely and independently rotate about each roller pad's longitudinal axis. The carriage assembly is able to pivot to a lowest position such that the carriage is positioned substantially under the slanted platform.

24 Claims, 8 Drawing Sheets

LOWER-BODY EXERCISE MACHINE

FIELD OF THE INVENTION

This invention relates to a lower-body exercise machine. More particularly, this invention relates to a new lower-body exercise machine allowing an exerciser to perform lower-body exercises requiring body motions through a range of body positions, perform effective shoulder shrugs between repetitions of the exercise, and easily and safely terminate and resume performance of the exercise.

BACKGROUND

As physical fitness becomes more popular, many attempts have been made to design exercise machines to imitate free-weight exercises. Exercise machines attempt to provide the benefits of an exercise traditionally performed with free-weights, while minimizing or eliminating the hazards of free-weight training. Exercise machines sometimes allow an exerciser to gain more benefit from an exercise than he would by performing it with free-weights. The most important free-weight exercise subject to being modeled by a machine is a lower-body exercise known as the deep knee bend, commonly referred to as the "squat." The squat exercises mainly, but not exclusively, the lower body and is important because it involves the body's biggest muscle groups, thus enabling an exerciser to build maximum strength and muscular size.

Traditionally, the squat exercise is performed with a weighted bar held across the exerciser's shoulders and behind his neck while squatting into a crouched position. The exerciser completes the exercise by standing up, all while steadying the weight bar.

The squat greatly benefits the thigh muscles of the exerciser. It has been shown that additional whole-body benefit is obtained by performing shoulder shrugs while in the standing position, especially during high repetition sets. Good form, especially keeping one's upper body reasonably upright, is necessary to obtain the desired benefits from the squat exercise, and also minimizes the physical hazards associated with it.

As commonly performed, the traditional squat exercise has several disadvantages, both physical and practical. The physical disadvantages relate to poor exercise form, which causes excessive strain on and often injuries to the knees and lower back of the exerciser. Knee strain is a result of improper orientation of the exerciser's lower legs with respect to the exerciser's upper body during the performance of the lower, and far more dangerous, half of the squat exercise. Ideally, the exerciser's lower legs and upper body should remain substantially parallel to each other during the performance of the lower half of the squat exercise, thus keeping the exerciser's knees substantially directly above his feet, and much more stationary, thereby minimizing knee strain. However, during the traditional squat exercise, the lower legs and upper body are usually not parallel during the lower half of the squat exercise, causing the exerciser's knees to move too far forward, which increases knee strain and the risk of injury.

Another physical danger is lower-back strain, which results from the exerciser leaning too far forward during the squat. Leaning too far forward can cause a condition known as lordosis, or "swayback," and serves only to exercise mainly the exerciser's hip muscles much more than his leg muscles.

One practical disadvantage relates to the need for an assistant, or spotter, when performing a squat, in case the exerciser should be unable to complete his last repetition and become stuck at or near the bottom of the exercise. Another practical disadvantage relates to the range of motion able to be performed during a typical free-weight squat. The exerciser is often limited to how low—i.e., how fully—he can squat safely due to improper exercise form, poor design of the apparatus and to other physical limitations. A further practical disadvantage is the fact that during a free-weight squat, the exerciser cannot easily stop, and subsequently resume the exercise conveniently and safely. Typically, to finish a set of free-weight squats, the exerciser must remove the weight bar from his shoulders and set it onto the floor or place it onto a squat rack.

Many squat machines have been developed to attempt to alleviate the problems and limitations associated with the traditional free-weight squat exercise. Typically, machines that have been designed to duplicate or improve the squat exercise either have the exerciser lying in a recumbent position in order to displace resistance away from his body, such as a sled or leg press, or have him oriented in a vertical or slanted position with his feet engaging the floor to press his body weight and any associated extra weight upwardly along a rail or guided path.

Many of the current squat machines have addressed some of the problems associated with the free-weight squat exercise, but have not alleviated certain other important problems. Certain dangers and limitations are still encountered by the exerciser when using these machines. For instance the exerciser's lower legs and upper body are prevented from achieving and maintaining the necessary parallelism during the lower half of a machine squat, thus aggravating knee strain and raising the risk of knee injury, as discussed above. Current machines also continue to aggravate lordosis. Furthermore, most of the machines do not enable the exerciser to stop the exercise at any of a plurality of positions to facilitate exiting the machine, or in case the exerciser becomes stuck in an awkward position. Also, current exercise machines orient the exerciser's legs so that the exercise is more of a hip exercise than a leg exercise.

Given the importance of shrugging against the available resistance at the top of each repetition of squats, another major limitation of current squat machines is that their flat, stationary backpads prevent the exerciser from performing shoulder shrugs. Typically, in squat machines utilizing a carriage which moves through any guided trajectory, the exerciser's feet are on the floor or a platform, and his shoulders engage shoulder-pads while his back typically engages a flat, stationary backpad. The squat exercise is performed by the exerciser pushing the carriage away from the floor by straightening his legs to apply a force primarily against the shoulder pads and to some extent against the backpad, thus raising the carriage, his own body weight and any additional weight loaded onto the carriage. At the top, or standing position, of the squat exercise, the exerciser ideally would perform a shoulder shrug. The combination of the shoulder pads and the flat backpad inhibits the breathing of the exerciser, as well as the actual movement necessary to perform a shoulder shrug. In addition, the more recumbent the position of an exerciser's upper body in a squat machine having a flat, stationary backpad, the more heavily his body weight presses against the backpad, which further impedes the shrugging exercise and the essential deep breathing necessary for the shoulder shrugs and for performing many consecutive repetitions.

The shoulder shrug has been shown to provide excellent additional muscle growth benefits when performed during a high repetition set by causing the exerciser to become fatigued more quickly. A properly performed squat is much more effective at building an exerciser's legs than is a leg press or a leg extension exercise, and intermittent shrugging during the same set makes it even more effective than squats alone would be.

Another shortcoming of the currently available squat machines is that they often allow a less than full range of motion due to the fact that the exerciser's feet engage the floor, or a platform that is too close to the floor. Regardless of how well a squat machine maintains the lower leg/upper body parallelism required to minimize knee strain, the maximum exercise benefit is obtained when the exerciser can perform a full-range squat without any limitation on the lower end of the lower half of a full squat exercise.

It is to overcome the shortcomings in the prior art that the present invention was developed.

SUMMARY

The present invention, in general terms, concerns a lower-body exercise machine that allows an exerciser to perform a squat without the dangers, distractions, and limitations encountered while performing a free-weight squat exercise. More particularly, the present invention allows an exerciser to move safely through a fuller range of motion than has previously been safely possible while performing the squat exercise, especially in the lower half of the squat exercise, breath freely and deeply throughout the performance of the squat exercise, shrug against the available resistance when he desires, and safely terminate and resume the squat exercise at any position during the performance of the squat exercise.

The lower-body exercise machine of the present invention provides functionality that overcomes the aforementioned problems. The lower-body exercise machine is mountable on a support surface and includes a frame, a carriage assembly pivotally attached to said frame and movable substantially upwardly and downwardly in an arcuate path about the frame, a support beam attached to and extending upwardly from the frame to be positioned outside of the arcuate path of the carriage assembly, and a platform attached to the frame and angling downwardly to engage the support surface.

A hookbar assembly is pivotally attached to the carriage assembly, and is pivotable to releasably engage the support beam to arrest the downward pivotal motion of the carriage assembly.

The hookbar assembly comprises a hookbar rotatably attached to the carriage assembly, an elongated hook defining a J-shaped upper end attached to and extending upwardly from the hookbar, with the J-shaped upper end oriented to face the support beam, and an elongated engagement handle attached to the hookbar, the handle extending forwardly from the hookbar toward said frame. A rung is attached to the support beam.

Raising the engagement handle in an upward direction rotates the hookbar and pivots the hook rearwardly toward the support beam to engage the nearest lower rung and stop the downward movement of the carriage and hold it securely aloft. To release the hook from the rung, the upward movement of the carriage assembly disengages the hook from the rung, since the greater mass of the either or both of the engagement levers (compared to that of the hook) causes the hook to pivot forwardly toward the carriage assembly.

The carriage assembly includes a carriage, which defines a front surface, a back surface, opposing lateral flanges, weight bars extending outwardly from the carriage, and two pivot bars attached to the carriage at one end and to the frame at their opposite ends. The front surface of the carriage includes a plurality of elongated cylindrical roller pads, each roller pad being rotatably attached to the carriage and able to rotate freely and independently about each roller pad's longitudinal axis. The roller pads provide adequate and comfortable support for the exerciser's back and allow him to breath freely and deeply while using the machine. The carriage also includes shoulder pads, which the exerciser engages while performing the squat exercise.

The carriage assembly is pivotable in an upwardly and downwardly arcuate path, the path being defined by the length of the pivot arms. The carriage assembly is able to pivot to a lowest position such that the carriage is substantially under the slanted platform, thereby allowing the exerciser to move through a full motion, especially in the lower half of the squat exercise, while maintaining parallelism between his lower legs and upper body.

A more complete appreciation of the present invention and its scope can be obtained from the accompanying drawings, which are briefly summarized below, the following detailed description of presently preferred embodiments, and the appended claims.

DESCRIPTION OF THE PREFERRED EMBODIMENT

Figure 1:
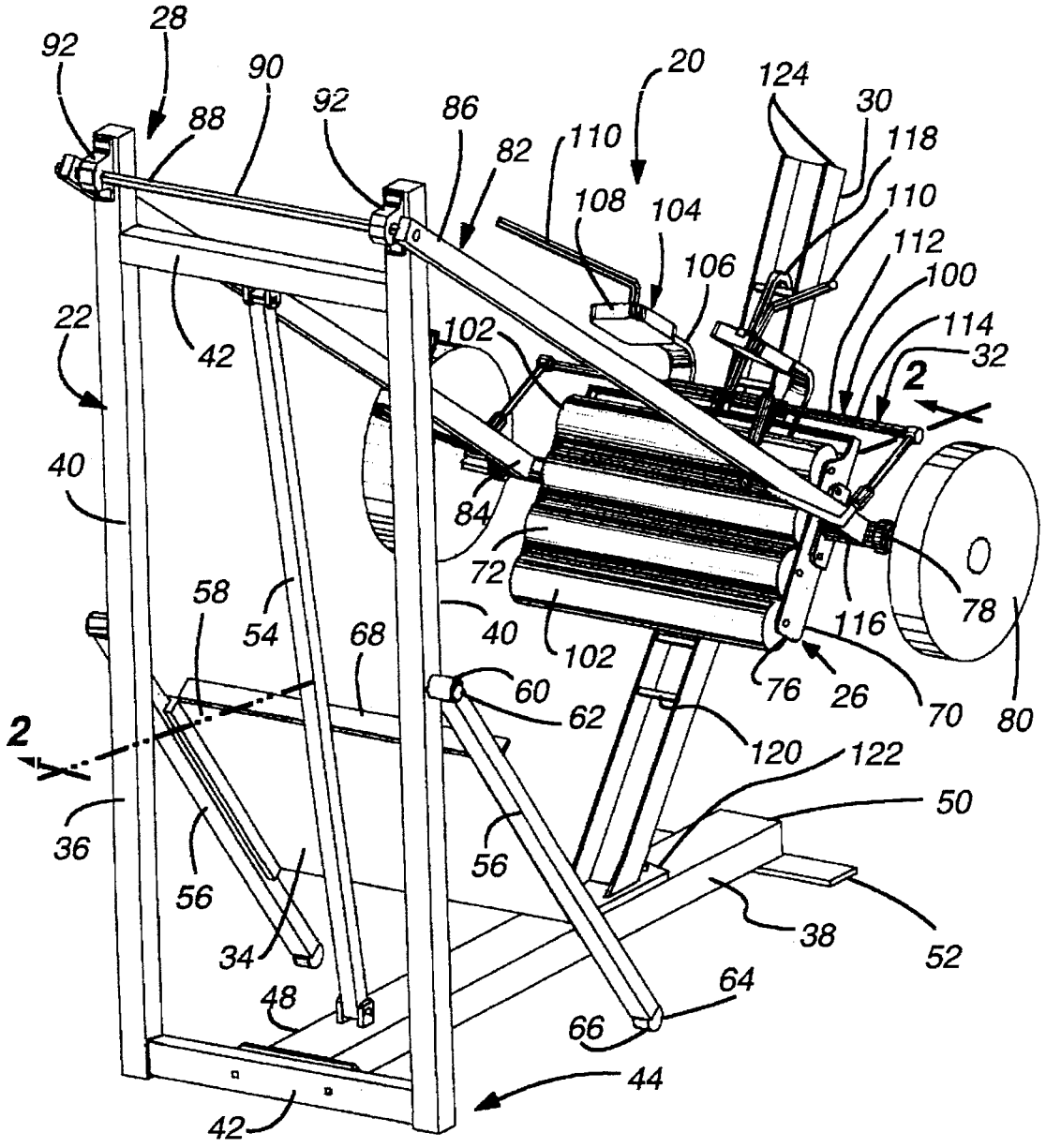
FIG. 1 is a front perspective view of a lower-body exercise machine incorporating the present invention, illustrating a frame, a carriage assembly, a platform, a support beam, a hookbar assembly, and roller pads.

Referring first to FIG. 1, an embodiment of the lower-body exercise machine 20 of the present invention is illustrated and includes a generally L-shaped frame 22 resting on a support surface 24, a carriage assembly 26 pivotally mounted at an upper end 28 of the L-shaped frame, a support beam 30 extending upwardly from the frame, a hookbar assembly 32 rotatably attached to the carriage assembly for engaging the support beam, and an elevated inclined platform 34 pivotally attached to the frame and engaging the support surface at one end. The support beam extends upwardly from the frame in an orientation so as to be adjacent to the path of the carriage assembly's movement.

Continuing with FIG. 1, the frame 22 comprises an upright portion 36 and a horizontal base portion 38, oriented substantially perpendicularly to one another. The upright portion 36 comprises two elongated and rigid posts 40 attached together by cross-beams 42 fixedly extending between both posts, one at the upper end 28, of the upright portion 36, and one at the lower end 44 of the upright portion. The lower end of the upright portion 36 is fixed to an end 48 of the base 38 of the frame 22, and rests on the support surface 24. The base portion 38 is an elongated and rigid beam, and extends away from the upright portion 36 along the support surface 24. The opposite end 50 of the base portion preferably rests on a plate 52, which engages the support surface. An elongated and rigid brace beam 54 is fixedly attached to the upper cross beam 42 and extends at an angle downwardly to the base 38, and is fixedly attached hereto. The brace beam assists in maintaining the structural integrity of the frame 22, as well as the substantially right angle orientation between the upright frame portion 36 and the base 38.

Figure 2:
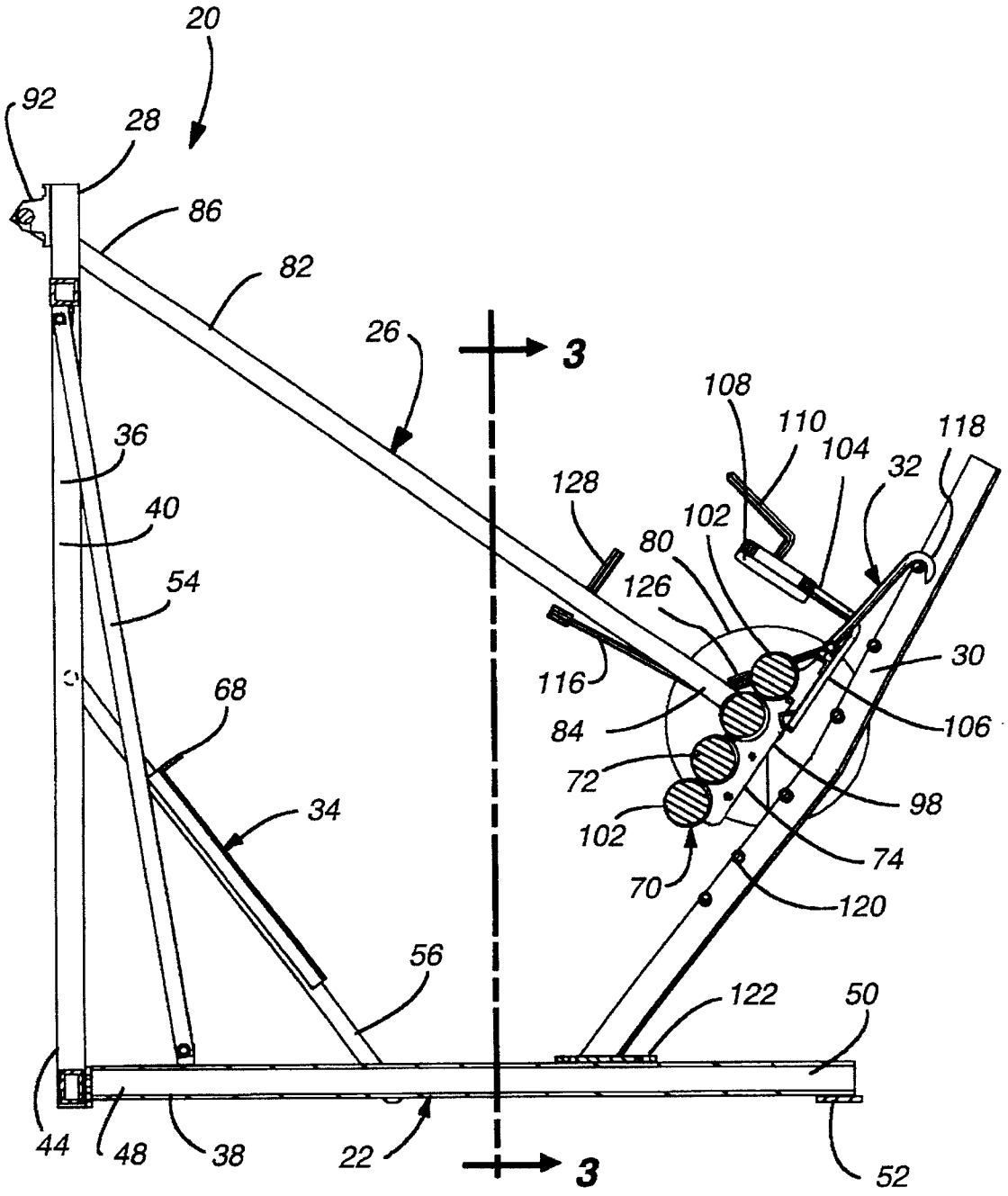
FIG. 2 is a section taken along line 2—2 of FIG. 1.

As shown in FIGS. 1 and 2, the platform 34 is pivotally attached to the upright portion 36 of the frame 22 and extends at an angle downwardly over the base member 38 to engage the support surface 24. In the illustrated embodiment, the platform 34 comprises two laterally opposing side beams 56 connected by a rigid plate 58, such as a steel plate. Each side beam 56 defines an aperture 60 at an upper end, for use in pivotally mounting the side beam to a cylindrical shaft 62 extending laterally outwardly from opposite sides of the upright frame portion 36. Each side beam 56 has a lower end defining a foot 64 for engaging the support surface 24. Preferably, each foot 64 defines a short cylinder having a cylindrical edge 66, with the cylindrical edge engaging the support surface 24. A toe plate 68 is mounted along a top edge of the plate 58 connecting the side beams 56. Preferably, the surface of the plate 58 is knurled or emory-taped, or otherwise treated to provide a frictional surface.

As shown in FIGS. 1–4, the carriage assembly 26 comprises a carriage 70 having a front surface 72, a back surface 74, and opposing lateral flanges 76. An elongated, cylindrical weight-bar 78 is fixedly attached to and extends perpendicularly outwardly from each lateral side of the carriage 70. The weight-bar 78 is for supporting any supplemental weight 80 that the exerciser desires to utilize during the use of the exercise machine 20.

Figure 4:
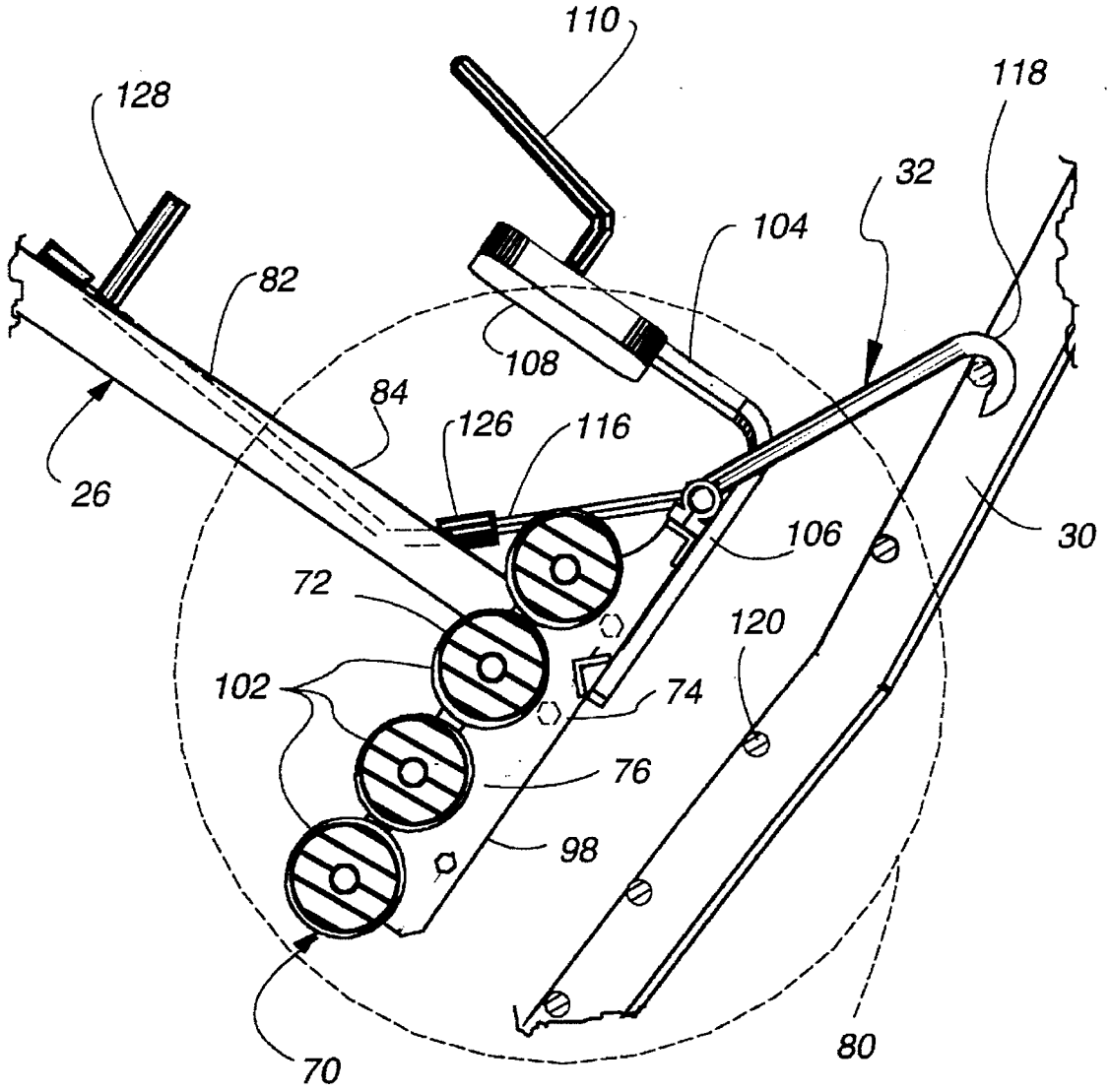
FIG. 4 is an enlarged section taken along line 4—4 of FIG. 3.
Figure 5:
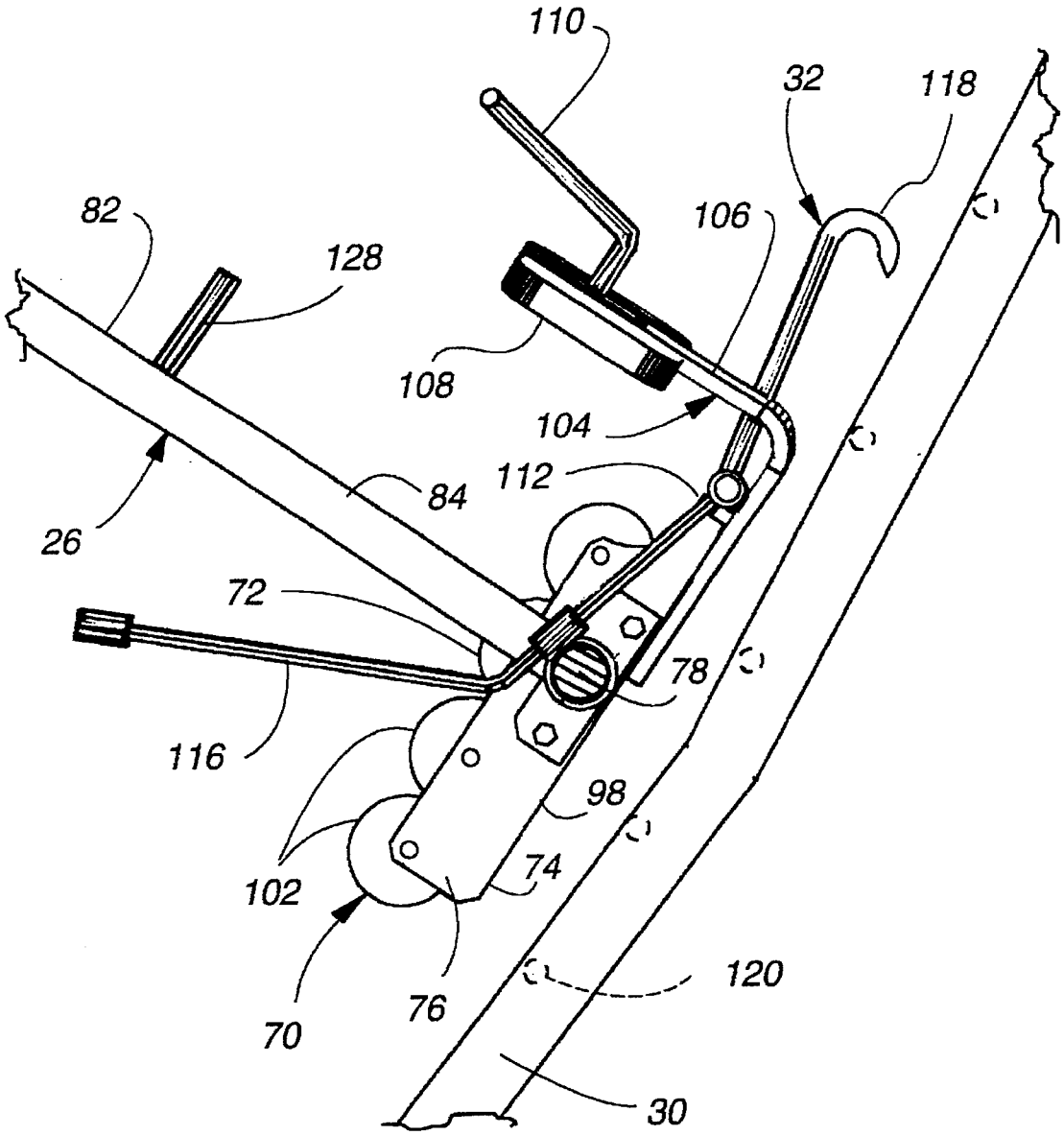
FIG. 5 is an enlarged section taken along line 5—5 of FIG. 3 with the hookbar assembly in a released position and not engaging the support beam.

As shown in FIGS. 1, 4 and 5, an elongated and rigid pivot arm 82 is fixedly attached at a first end 84 to each weight-bar 78, and extends substantially perpendicularly away from the front surface 72 of the carriage 70. A second end 86 of each pivot arm 82 is pivotally attached to the upper end 28 of the frame 22 to allow the carriage 70 to pivot through an arc of a circle, whose radius is defined by the length of the pivot arm. Preferably, the second ends 86 of the pivot arms 82 are fixedly attached to opposing ends 88 of a pivot bar 90, which is rotatably mounted at the upper end 28 of the frame 22. The pivot bar 90 is an elongated cylindrical rod, and is rotatably mounted to the frame 22 in any conventional manner, such as by pillow block bearings 92. The pivot bar 90 is attached to the posts 40 of the upright portion 36 of the frame 22 on the side of the frame opposite from the carriage 70. This is the safest position and most effectively utilizes the strength of the upright portion 36 in supporting the weight of the carriage assembly 26, the exerciser, and any supplemental weights 80.

Figure 6:
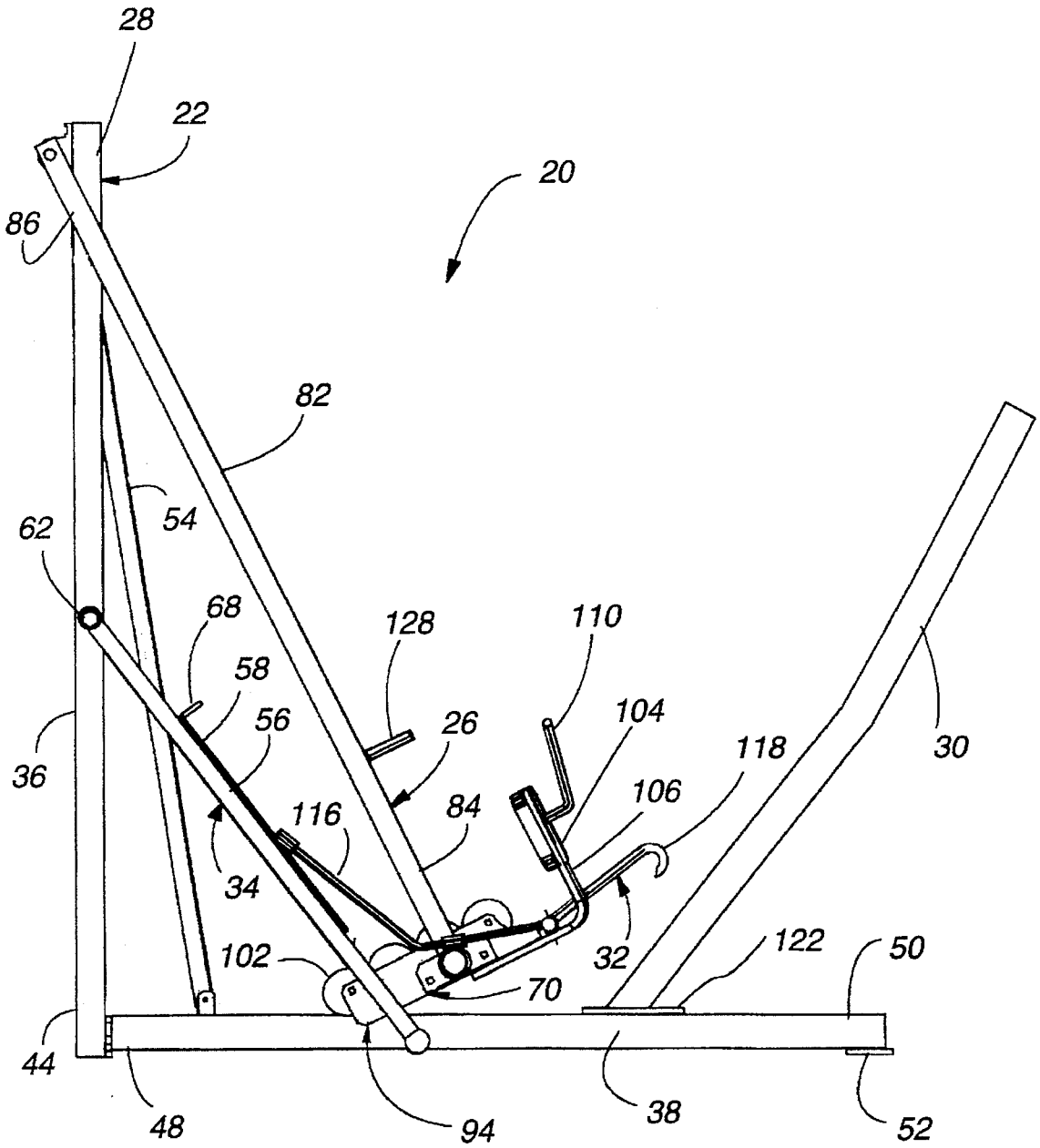
FIG. 6 is an elevational view of the present invention showing the carriage assembly at a first, or lowest, position in the arcuate path of motion of the carriage assembly.
Figure 7:
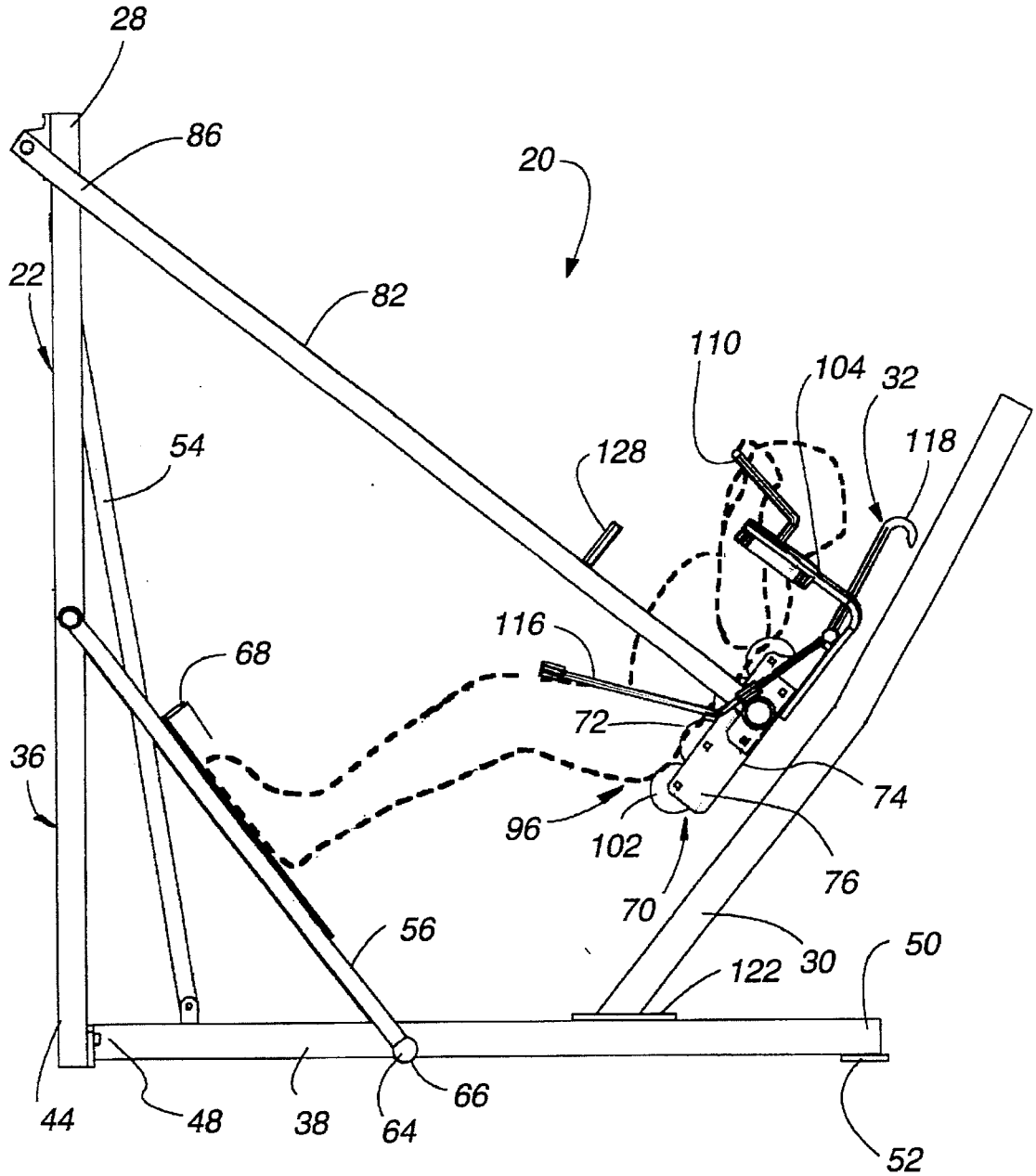
FIG. 7 is an elevational view of the present invention showing an exerciser positioned in the machine, and the carriage assembly at a substantially uppermost position for the performance of the squat exercise.

The carriage assembly 26 can pivot about its attachment point to the frame 22 in an arc defined by the length of the pivot arms 82. The carriage assembly 26 pivots between a first position 94, or the low point, as shown in FIG. 6, and up to a second position 96, which depends on the person using the exercise machine 20, as shown in FIG. 7. The first position is defined where the carriage assembly engages the base of the frame.

Figure 3:
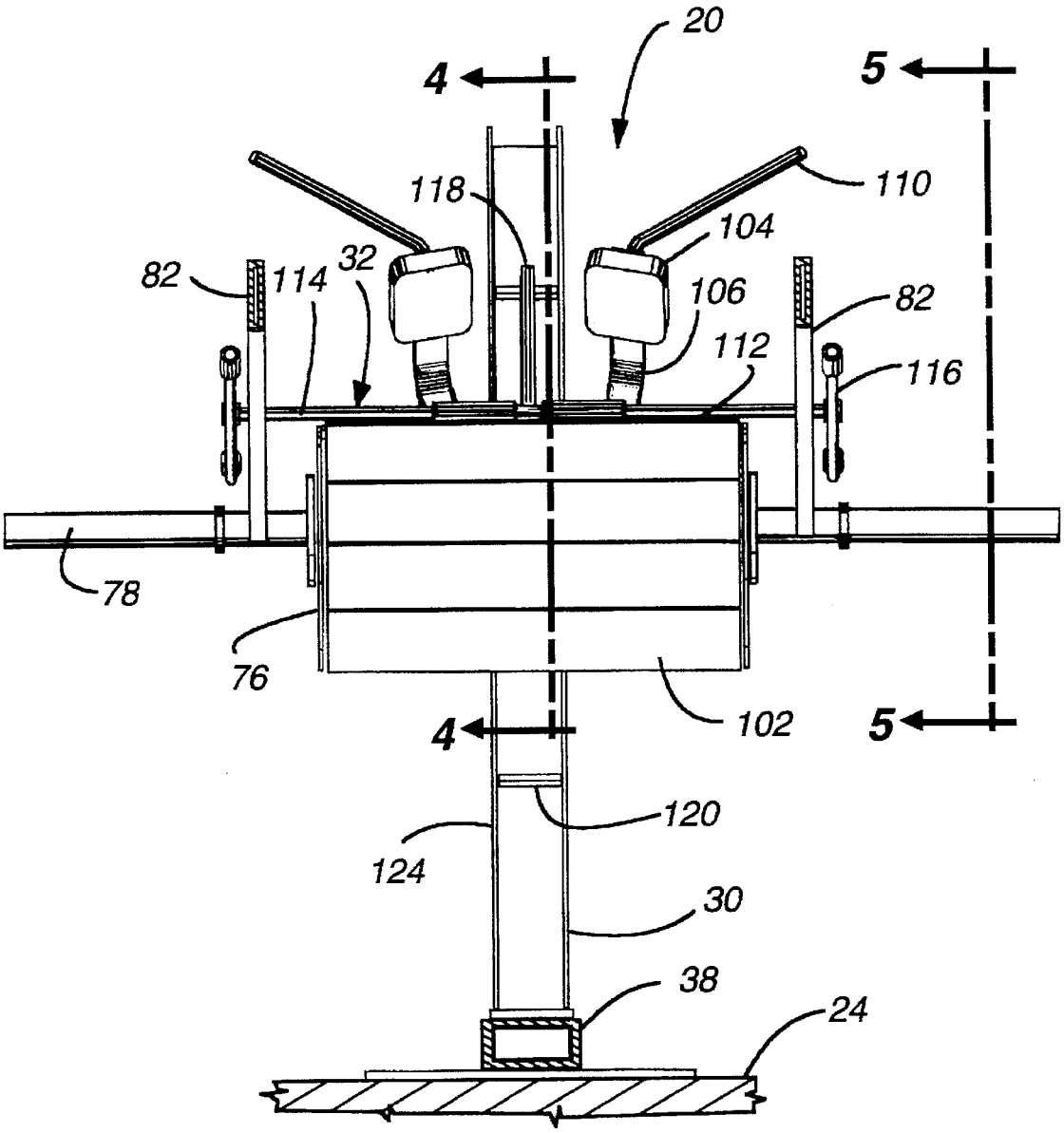
FIG. 3 is a section taken along line 3—3 of FIG. 2.
Figure 8:
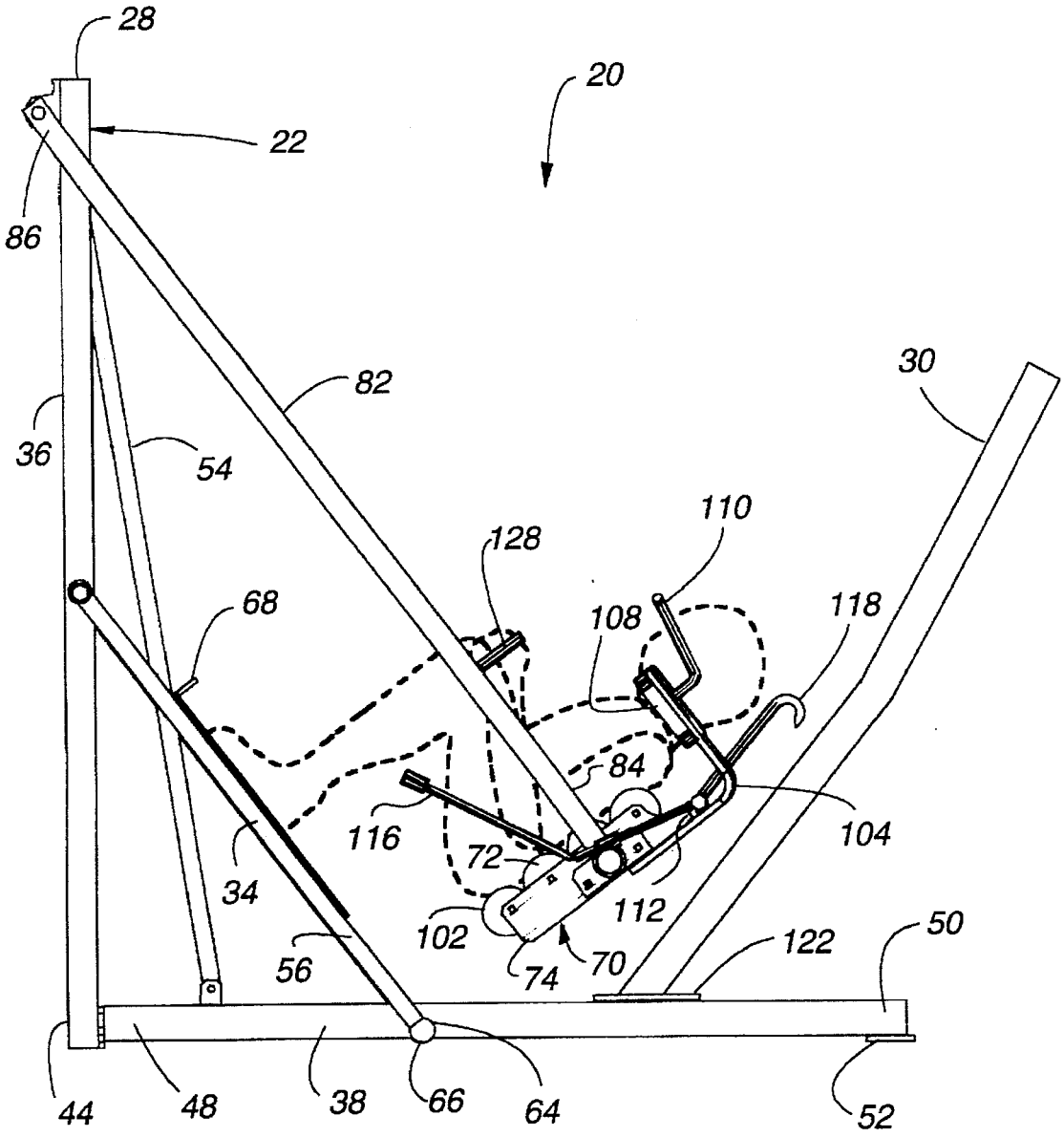
FIG. 8 is an elevational view of the present invention showing an exerciser positioned in the machine, and the carriage assembly at a substantially lowest position for the performance of the squat exercise.

As shown in FIGS. 3, 7 and 8, the carriage 70 further comprises a rigid backplate 98 defining the back surface 74, a hookbar assembly 32, and a plurality of roller pads 102 rotatably mounted on the backplate 98, which define the front surface 72. The roller pads 102 are rotatably mounted between the flanges 76 in a horizontal orientation, and can rotate freely and independently from one another. The roller pads 102 are rigid enough to support the forces created as a result of the exerciser pressing against them, but are heavily padded to allow for comfort during use.

A pair of shoulder pads 104 are fixedly attached to the back plate 98, and extend upwardly and forwardly to bend over the carriage 70. Each shoulder pad 104 comprises an L-shaped steel member 106 with one leg being welded or bolted to the back plate 98 of the carriage 70, and with the other leg extending forwardly from the carriage. A padded surface 108 is provided on a lower face of the forwardly extending leg to allow an exerciser to press against the shoulder pad 104 in relative comfort. Each shoulder pad 104 is tilted about 15° outwardly, as shown in FIG. 1, so as to conform to the slope of various exercisers' shoulders. The shoulder pads define upper handholds 110 extending upwardly from each of the shoulder pads 104. The shoulder pads that extend from the back plate 98 are for engaging the exerciser's shoulders when utilizing the leg exercise machine 20. The shoulder pads 104 are sufficiently rigid to bear the weight lifted by the exerciser using the exercise machine 20.

Referring to FIGS. 4 and 5, the hookbar assembly 32 is pivotally attached to the carriage 70 along a top surface 112 of the back plate 98. The hookbar assembly 32 comprises a laterally extending rigid hook bar 114 pivotally mounted along the top 112 of the back plate 98, at either end of which is attached a forwardly and downwardly extending engagement lever 116. An elongated hook 118 is fixedly attached to the hook bar 114, and extends upwardly therefrom. The hook 118 faces away or rearwardly from the carriage to releasably engage any one of the plurality of rungs 120 in the support beam 30, as described hereinafter.

The engagement levers 116 are heavier and longer than the hook 118, and thus tend to bias the hookbar assembly 32 to pivot in a forward direction (counter-clockwise as shown in FIG. 5). Thus, when the hook is not engaged with a rung 120 in the support beam 30, the engagement levers bias the hookbar assembly 32 to a forward position, such that the engagement levers 116 contact the weight bar 78, and the hook 118 is not able to engage any of the rungs 120 in the support beam 30, as shown in FIG. 5. This allows the free movement of the carriage assembly 26 about its pivot point without the hookbar assembly 32 engaging the rungs 120 on the support beam 30. When the engagement lever 116 is pivoted upwardly, this causes the hookbar assembly 32 to pivot rearwardly away from the carriage assembly 26 (clockwise as shown in FIG. 4), and allows the hook 118 to engage any nearby rung 120 found on the support beam 30. The engagement lever 116 does not contact the weight bar 78 when the hook 118 is engaged with any rung 120. When the hook 118 is engaged with a rung 120, the carriage assembly 26 is maintained in a stationary suspended position and is not able to be used by an exerciser because the carriage assembly 26 cannot pivot in a downward direction to perform the exercise.

When the carriage assembly 26 is moved in an upwardly direction a sufficient amount, the hook 118 automatically disengages from the rung 120, and allows the carriage assembly to move upwardly and downwardly as needed for performing the exercise, as shown in FIGS. 7 and 8.

The support beam 30 is fixedly attached at one end to the base portion 38 of the frame 22, and extends upwardly and rearwardly therefrom. The support beam 30 is attached to the base portion 38 by any adequate means, such as welding the end of the support beam 30 to a plate 122 and bolting the plate 122 to the base member 38. In the disclosed embodiment, the support beam 30 is an elongated and rigid non-straight channel-iron having rungs 120 fixedly positioned between the flanges 124 of the channel-iron. The channel-iron is bent at a slight angle at one point along its length so as to sufficiently accommodate the path of motion of the carriage assembly 26, and to allow the hookbar assembly 32 to pivot rearwardly to releasably engage any one of the rungs 120 as necessary, as shown in FIG. 2. In the illustrated embodiment, the rungs 120, while not being equidistant from the pivot point of the carriage assembly 26, are adequately positioned to be within reach of the hookbar assembly 32 to allow the hookbar assembly 32 to engage any rung 120 and support the carriage 70 on the support beam 30. It is also contemplated that the support beam 30 can be continuously curved to exactly accommodate the path of motion of the carriage assembly 26, and thus place all of the rungs 120 equidistant from the pivot point of the carriage assembly 26.

Regarding FIG. 5, the carriage assembly 26 is shown with the hookbar assembly 32 disengaged from the rungs 120 on the support beam 30, thus allowing the carriage assembly to pivot through its full range of motion. When the hookbar assembly 32 is disengaged from the support beam 30, the hook bar 114 rotates in a counter-clockwise direction (with respect to FIG. 5) such that the engagement levers 116 contact the weight bars 78, as described above. A rubber pad 126 is mounted on the engagement levers 116 to cushion the impact between the engagement levers and the weight bar when the hookbar assembly 32 disengages automatically from the support beam 30. Lower handholds 128 mounted to extend perpendicularly upwardly from each of the pivot arms 82 to be grasped by the exerciser during use of the exercise machine 20.

Referring to FIG. 6, the carriage assembly 26 is shown in the first position 94, at its lowest point. This position is limited only by the point where the lowest roller pad 102 engages the horizontal base portion 38, or where any supplemental weight 80 mounted on the weight-bar 78 contacts the support surface 24. This lowest position is adequate to allow an exerciser to utilize the lower-body exercise machine 20 through a full range of motion while performing the lower half of the squat exercise.

In operation, the exercise machine 20 is utilized by one exerciser to perform an exercise analogous to a free-weight squat exercise, while minimizing the dangers and impracticalities of performing the squat exercise with free-weights or with a machine. Before the exerciser enters the machine 20 to begin exercising, the carriage assembly 26 is suspended in a fixed position by engaging the hookbar assembly 32 with a rung 120 in the support beam 30. This fixed position allows the exerciser to add supplemental weights 80 to the weight-bars 78 as desired, as shown in FIGS. 2, 4 and 6.

With the carriage assembly 26 suspended on the support beam 30, the exerciser may freely enter the exercise machine 20 and prepare to begin the squat exercise. When the exerciser enters the machine 20, he rests his back on the roller pads 102, slides upwardly until his shoulders engage the shoulder pads 104, and places his feet on the platform 34. Since the exerciser's knees will feel only a two or three-inch difference of placement on the platform, foot placement is extremely important because minimizing stress on his knees depends upon the relative positions of the exerciser's feet and upper body to each other while performing the squat exercise.

The platform 34 is wide enough and deep enough to accommodate exercisers using any stance and having any combination of thigh length, body length, and lower leg length. The platform 34 is also finished with a frictional surface to keep the exerciser's feet from slipping during the exercise. The exerciser can grasp either the lower handholds 128 or the upper handholds 110 as desired. Once correctly positioned within the exercise machine 20, the exerciser is in a semi-supine position, being more supine during the lower half of the exercise, and being less supine (i.e., or more vertically oriented) during the upper half of the exercise, as described hereinafter.

In using the exercise machine 20, the resistance that the exerciser encounters includes his body weight (i.e., all but his lower legs), the weight of the carriage 70 and the pivot arms 82, and any supplemental weights 80 the exerciser has added to the carriage on the weight bars 78. When in the machine 20, the exerciser is engaged along the length of his back with the roller pads 102 on the carriage 70, as well as upon his shoulders by the shoulder pads 104. The exerciser's feet rest on the platform 34, upon which he pushes to lift the carriage 70 up, and against which he pushes to resist the downward movement of the carriage 70.

Once properly positioned within the exercise machine 20, the exerciser begins the exercise by engaging his shoulders and his back against the carriage 70 and pressing downwardly (i.e., straightening his legs) against the platform 34 with his feet, thus raising the carriage 70 along its arcuate trajectory. Once the carriage 70 has been raised to a predetermined extent, the hook 118 releases itself from the rung 120, and automatically pivots forwardly toward the carriage 70 and the exerciser. The hookbar assembly 32 automatically pivots forwardly because of the greater mass of either or both of the engagement levers 116, as discussed above. The cushioned engagement levers 116 fall against the weight bars 78 to stop their movement.

The hookbar assembly 32 allows the exerciser to enter the machine 20 after adding any desired supplemental weights 80, and simply begin exercising by raising the carriage 70, which automatically releases the hookbar assembly 32 after the carriage has been lifted a certain amount, as discussed above. This allows the exerciser to move unhindered through the full range of motion.

The exercise machine 20 also allows the exerciser to exercise through a full range of motion from the top, or second position 96, of the exercise, where the legs are substantially straight, to the lower end, or first position 94, of the exercise motion where the exerciser is crouched down. The carriage 70 dimension is such that it can fit between the side beams 56 of the platform 34. This allows the exerciser to move through a full range of motion, limited only by his flexibility. The size of the platform 34, as well as the path of motion of the carriage assembly, allows the exerciser to maintain excellent parallelism between his lower legs and upper body during the lowest part of the exercise, as shown in FIG. 8. Also depicted in FIG. 8 is the orientation of the exerciser's body at close to the lowest point of the exercise. The exerciser's body is virtually below his lower legs. Further, in the lowest point of the exercise, the exerciser's lower back is pulled slightly forward and away from the bottom roller. This effect helps counteract lordosis.

At the upper end of the exercise as shown in FIG. 7, the exerciser's body is slightly bent at the waist, while his legs are substantially straight, thereby minimizing the aggravation of the lordosis, or swayback, because the lower back is not set at a forward angle such as when the exerciser is performing a free-weight squat exercise.

Another of the major benefits of the present invention is that the exerciser is able to easily perform shoulder shrugs at the second 96 or standing position of the exercise. Shoulder shrugs have been found to be especially beneficial when performed during high-repetition sets. The problem is recognized in that the typically flat, stationary pads behind the exerciser's back makes it difficult for the exerciser to breathe freely and impossible to perform effective shrugs in any event. The problem is solved by the present apparatus in substituting roller pads 102 for the flat, stationary backpad, thus permitting unrestricted shrugging and deep breathing. If the exerciser is able to breathe more freely and more deeply during high-repetition sets, the ability to perform additional repetitions is enhanced, which in turn greatly enhances the overall benefit of the exercise. Shoulder shrugs can be performed while grasping either the upper or the lower handholds 110, 128 but grasping the upper handholds 110, as in FIG. 7, makes shrugging easier and more effective.

A further benefit of the present invention is related to the safety and convenience provided by the hookbar assembly 32. When the exerciser is ready to exit the exercise machine 20, the exerciser simply raises either or both of the engagement levers 116 of the hookbar assembly 32, which causes the rearward movement of the hook 118 so it can re-engage itself onto any rung of the support beam. If the exerciser moves the engagement levers 116 in this direction while slowly allowing the carriage 70 to move in a downward motion, the hook 118 will engage one of the rungs 120 in the support beam 30, thereby supporting the carriage assembly 26 and removing the resistance from the exerciser. In this manner, the exerciser can easily and safely exit the exercise machine 20 and later re-enter it to resume the exercise, when desired. When the hook 118 is engaged with a rung 120, the counterbalancing engagement levers 116 do not cause the disengagement of the hook 118 from the rung because the carriage far outweighs the levers also, and because the hook surrounds the rung sufficiently to prevent any forward motion of the hook.

Although the present invention has been described with a certain degree of particularity, it is understood that the present disclosure has been made by way of example, and changes in detail or structure may be made without departing from the spirit of the invention, as defined in the appended claims.

I claim:

1. A lower-body exercise machine, said machine comprising:

a. a frame adapted to be supported upon a support surface;

b. a carriage assembly having a first end and a second end, said second end pivotally attached to said frame causing said carriage assembly to pivot about said frame substantially upwardly and downwardly in an arcuate path;

c. a support beam fixedly attached to and extending upwardly beyond said frame and being positioned outside of the arcuate path of motion permitted of said first end of said carriage assembly;

d. a platform pivotally attached to said frame at first end and adapted to engage the support surface at a second edge; and e. a hookbar assembly pivotally attached to said carriage assembly, said hookbar assembly being pivotable to releasably engage said support beam and arrest the downward pivotable motion of said carriage assembly.

2. An exercise machine as defined in claim 1, wherein said frame has an upper end, and said second end of said carriage assembly is pivotally attached to said upper end.

3. A lower-body exercise machine as defined in claim 1, wherein:

a. said platform defining two spaced-apart laterally opposing side beams interconnected by a plate, said platform pivotally attached to said frame at a first end of each of said side beams, and adapted to engage the support surface at a second end of each of said side beams, and wherein said plate is suspended above the support surface; and b. said carriage assembly moveably positioned along said arcuate path between said platform and the support surface, thereby defining a lowest or first position.

4. A lower-body exercise machine, said machine comprising:

a. a frame adapted to be supported upon a support surface, said frame having an upper end;

b. a carriage assembly having a first and second end, said second end being pivotally attached to said frame causing said carriage assembly to pivot about said frame in an arcuate path substantially upwardly and downwardly;

c. a platform defining two spaced-apart laterally opposing side beams interconnected by a plate, said platform pivotally attached to said frame at a first end of each of said side beams, and adapted to engage the support surface at a second end of each of said side beams, and wherein said plate is suspended above the support surface; and d. said carriage assembly moveably positioned along said arcuate path between said platform and the support surface, thereby defining a lowest or first position.

5. A lower-body exercise machine as defined in claim 4, said machine comprising:

a. a support beam fixedly attached to and extending upwardly beyond said frame and positioned radially outside of the arcuate path of motion permitted of said carriage assembly; and b. a hookbar assembly pivotally attached to said carriage assembly, said hookbar assembly being pivotable to releasably engage said support beam and arrest the downward pivotable motion of said carriage assembly.

6. An exercise machine as defined in claim 4, wherein said carriage assembly is pivotally attached to said upper end of said frame.

7. An exercise machine as defined in claim 4, wherein:

a. said carriage assembly comprises:

b. a carriage defining a back surface and opposing sides;

c. an elongated weight bar fixedly mounted to and extending perpendicularly outwardly from each of said sides of said carriage;

d. two pivot arms, each arm defining a first end and a second end, said first ends each attached to one of said weight bars, and each of said second ends pivotally attached to said upper end of said frame to allow pivotal movement of said carriage; and e. two substantially rigid shoulder pads, each defining two opposing ends, one end of each of said shoulder pads being fixedly attached to said back surface of said carriage, and said opposing end of each of said shoulder pads extending forwardly toward said upper end of said frame, said opposing ends being padded.

8. An exercise machine as defined in claim 7, wherein:

a. said carriage defines a front surface;

b. said front surface of said carriage defining a plurality of roller pads, each roller pad being rotatably attached to said carriage, each roller pad being freely and independently rotatable.

9. An exercise machine as defined in claim 8, wherein said carriage further comprises:

a. a pair of upper handholds, each fixedly attached to and extending upwardly from one of said shoulder pads; and b. a pair of lower handholds, each fixedly attached to and extending upwardly from one of said pivot arms.

10. A lower-body exercise machine for use by an exerciser having a back, feet, and upper and lower legs, said machine comprising:

a. a frame adapted to be supported upon a support surface and defining an upper end;

b. a carriage assembly pivotally attached to said upper end of said frame, and pivotable about said frame substantially upwardly and downwardly in an arcuate path;

c. a platform pivotally attached to said frame below said upper end at a first end and adapted to engage the support surface at a second end; and d. said carriage assembly defining a carriage, said carriage having a front surface said front surface of said carriage defining a plurality of roller pads, each roller pad being rotatably attached to said carriage, each roller pad being freely and independently rotatable.

11. A lower-body exercise machine comprising:

a. a frame adapted to be supported upon a support surface and having an upper end;

b. a carriage assembly pivotally attached to said frame, and pivotable about said frame substantially upwardly and downwardly in an arcuate path;

c. a support beam fixedly attached to and extending upwardly beyond said frame and being positioned outside of the arcuate path of motion permitted of said carriage assembly, and including a rung fixedly attached to said support beam;

d. a platform pivotally attached to said frame at a first end and adapted to engage the support surface at a second end; and e. a hookbar assembly pivotally attached to said carriage assembly, said hookbar assembly being pivotable to releasably engage said support beam and arrest the downward pivotable motion of said carriage assembly, and further comprising:

a hook bar rotationally mounted to said carriage assembly;

a rigid elongated hook defining a J-shaped upper end, said hook fixedly attached to and extending upwardly from said hook bar, and said J-shaped upper end oriented to substantially face said support beam;

an elongated engagement handle fixedly attached to said hook bar, said handle extending outwardly from said hook bar substantially toward said frame; and f. wherein the movement of the engagement handle in an upward direction rotates said hook bar and pivots said hook rearwardly towards said support beam to releasably engage said rung to arrest the downward movement of the carriage assembly.

12. An exercise machine as defined in claim 11, wherein said carriage assembly comprises:

a. a carriage defining a back surface and opposing sides;

b. an elongated weight bar fixedly mounted to and extending perpendicularly outwardly from each of said sides of said carriage;

c. two pivot arms, each arm defining a first end and a second end, said first ends each attached to one of said weight bars, and each of said second ends pivotally attached to an upper end of said frame to allow pivotal movement of said carriage; and d. two substantially rigid shoulder pads, each defining two opposing ends, one end of each of said shoulder pads being fixedly attached to said back surface of said carriage, and said opposing end of each of said shoulder pads extending forwardly toward said upper end of said frame, said opposing ends being padded.

13. An exercise machine as defined in claim 12, wherein:

a. said carriage defines a front surface;

b. said front surface of said carriage defining a plurality of roller pads, each roller pad being rotatably attached to said carriage, each roller pad being freely and independently rotatable.

14. An exercise machine as defined in claim 13, wherein said carriage further comprises:

a. a pair of upper handholds, each fixedly attached to and extending upwardly from one of said shoulder pads; and b. a pair of lower handholds, each fixedly attached to and extending upwardly from one of said pivot arms.

15. An exercise machine as defined in claim 11, wherein movement of said carriage assembly in the upward direction disengages said hook from said rung, causing the hookbar assembly to rotate in a forwardly direction away from said support beam and allows unobstructed movement of said carriage assembly in said arcuate path.

16. A lower-body exercise machine comprising:

a. a frame defining an upper end and adapted to be supported upon a support surface, said frame having an upper end;

b. a carriage assembly pivotally attached to said upper end of said frame, and pivotable about said frame in an arcuate path substantially upwardly and downwardly;

c. a platform defining two spaced-apart laterally opposing side beams interconnected by a plate, said platform pivotally attached to said frame at a first end of each of said side beams, and adapted to engage the support surface at a second end of each of said side beams, and wherein said plate is suspended above the support surface;

d. a support beam fixedly attached to and extending upwardly beyond said frame and positioned outside of the arcuate path of motion permitted of said carriage assembly;

e. a hookbar assembly pivotally attached to said carriage assembly, said hookbar assembly being pivotable to releasably engage said support beam and arrest the downward pivotable motion of said carriage assembly; and f. said carriage assembly moveably positioned along said arcuate path between said platform and the support surface, thereby defining a lowest or first position.

17. An exercise machine as defined in claim 16, the hookbar assembly further comprises:

a. a hook bar rotatably attached to said carriage assembly;

b. a rigid elongated hook defining a J-shaped upper end, said hook fixedly attached to and extending upwardly from said hook bar, and said J-shaped upper end oriented to substantially face said support beam;

c. an elongated engagement handle fixedly attached to the hook bar, said handle extending outwardly from said hook bar substantially toward said frame;

and wherein said support beam further comprises:

d. a rung fixedly attached to said support beam; and wherein the movement of the engagement handle in an upward direction rotates said hook bar and pivots said hook rearwardly towards said support beam to releasably engage said rung to arrest the downward movement of the carriage assembly.

18. An exercise machine as defined in claim 17 wherein movement of said carriage assembly in the upward direction disengages said hook from said rung, causing the hook bar assembly to rotate in a forwardly direction away from said support beam and allows unobstructed movement of said carriage assembly in said arcuate path.

19. A lower-body exercise machine comprising:

a. a frame adapted to be supported upon a support surface and defining an upper end;

b. a carriage assembly pivotally attached to said upper end of said frame, and pivotable about said frame substantially upwardly and downwardly in an arcuate path;

c. a platform pivotally attached to said frame below said upper end at a first end and adapted to engage the support surface at a second end;

d. said carriage assembly defining a carriage, said carriage having a front surface;

e. said front surface of said carriage defining a plurality of roller pads, each roller pad being rotatably attached to said carriage, each roller pad being freely and independently rotatable;

f. a support beam fixedly attached to and extending upwardly beyond said frame and positioned outside of the arcuate path of motion permitted of said carriage assembly; and g. a hookbar assembly pivotally attached to said carriage, said hookbar assembly being pivotable to releasably engage said support beam and arrest the downward pivotable motion of said carriage assembly.

20. An exercise machine as defined in claim 19, wherein said carriage assembly is pivotally attached to said upper end.

21. An exercise machine as defined in claim 20, wherein the hookbar assembly further comprises:

a. a hook bar rotatably attached to said carriage assembly;

b. a rigid elongated hook defining a J-shaped upper end, said hook fixedly attached to and extending upwardly from said hook bar, and said J-shaped upper end oriented to substantially face said support beam;

c. an elongated engagement handle fixedly attached to the hook bar, said handle extending outwardly from said hook bar substantially toward said frame;

and wherein said support beam further comprises:

d. a rung fixedly attached to said support beam; and wherein the movement of the engagement handle in an upward direction rotates said hook bar and pivots said hook rearwardly towards said support beam to releasably engage said rung to arrest the downward movement of the carriage assembly.

22. An exercise machine as defined in claim 21, wherein movement of said carriage assembly in the upward direction disengages said hook from said rung, causing the hookbar assembly to rotate in a forwardly direction away from said support beam and allows unobstructed movement of said carriage assembly in said arcuate path.

23. An exercise machine as defined in claim 22, wherein said carriage assembly further comprises:

a. said carriage defining a back surface and opposing sides;

b. an elongated weight bar fixedly mounted to and extending perpendicularly outwardly from each of said sides of said carriage;

c. two pivot arms, each arm defining a first end and a second end, said first ends each attached to one of said weight bars, and each of said second ends pivotally attached to said upper end of said frame to allow pivotal movement of said carriage; and d. two substantially rigid shoulder pads, each defining two opposing ends, one end of each of said shoulder pads being fixedly attached to said back surface of said carriage, and said opposing end of each of said shoulder pads extending forwardly toward said upper end of said frame, said opposing ends being padded.

24. An exercise machine as defined in claim 23, wherein said carriage further comprises:

a. a pair of upper handholds, each fixedly attached to and extending upwardly from one of said shoulder pads; and b. a pair of lower handholds, each fixedly attached to and extending upwardly from one of said pivot arms.

* * * * *